US008096157B2

(12) United States Patent
Mueller et al.

(10) Patent No.: US 8,096,157 B2
(45) Date of Patent: Jan. 17, 2012

(54) METHOD AND DEVICE FOR ROLLING UP A METAL STRIP

(75) Inventors: Heinz-Adolf Mueller, Wilnsdorf (DE); Oalf Norman Jepsen, Siegen (DE)

(73) Assignee: SMS Demag Aktiengesellschaft, Duesseldorf (DE)

( * ) Notice: Subject to any disclaimer, the term of this patent is extended or adjusted under 35 U.S.C. 154(b) by 609 days.

(21) Appl. No.: 12/306,756

(22) PCT Filed: Jun. 12, 2007

(86) PCT No.: PCT/EP2007/005157

§ 371 (c)(1),
(2), (4) Date: Dec. 29, 2008

(87) PCT Pub. No.: WO2008/000348

PCT Pub. Date: Jan. 3, 2008

(65) Prior Publication Data

US 2009/0184191 A1 Jul. 23, 2009

(30) Foreign Application Priority Data

Jun. 28, 2006 (DE) ..... 10 2006 029 858

(51) Int. Cl.
*B21D 1/05* (2006.01)
*B21C 47/04* (2006.01)

(52) U.S. Cl. ..... 72/161; 72/11.5; 72/13.4; 72/162; 72/201; 242/535

(58) Field of Classification Search ..... 242/535; 72/7.4, 7.5, 11.1, 11.5, 12.5, 13.4, 160, 161, 72/162, 201

See application file for complete search history.

(56) References Cited

U.S. PATENT DOCUMENTS

| | | | | |
|---|---|---|---|---|
| 4,809,528 A * | 3/1989 | Lawson et al. | ..... | 72/12.3 |
| 5,950,476 A * | 9/1999 | Brashear | ..... | 72/205 |
| 6,128,937 A | 10/2000 | Seidel | ..... | 72/161 |

FOREIGN PATENT DOCUMENTS

| | | |
|---|---|---|
| JP | 56025326 B | 11/1981 |
| JP | 58032521 | 2/1983 |
| JP | 58058931 | 4/1983 |
| JP | 0611439 | 4/1994 |
| JP | 07075830 | 3/1995 |
| JP | 07080531 | 3/1995 |
| JP | 2006102780 | 4/2006 |

* cited by examiner

*Primary Examiner* — David Jones
(74) *Attorney, Agent, or Firm* — Andrew Wilford

(57) ABSTRACT

The invention relates to a method for rolling up a metallic strip (1), in particular a steel strip, to a coil (2), the strip (1) being kept under longitudinal tension between a driver (3), consisting of at least one driver top roll (4) and at least one driver bottom roll (5), and a winding pin (6). The strip (1) is rolled up on the winding pin (6) to form the coil (2). In order to prevent the undesired opening of the wound coil in a simple manner, a bending moment (MB) is initiated in the strip, said bending moment acting perpendicular to the longitudinal direction of the strip (1) and causing a plastic deformation when a defined remaining length of the strip (1) is reached. The invention also relates to a device for rolling up a metallic strip.

6 Claims, 3 Drawing Sheets

METHOD AND DEVICE FOR ROLLING UP A METAL STRIP

CROSS REFERENCE TO RELATED APPLICATIONS

This application is the US national phase of PCT application PCT/EP2007/005157, filed 12 Jun. 2007, published 3 Jan. 2008 as WO2008/000348, and claiming the priority of German patent application 102006029858.6 itself filed 28 Jun. 2006, whose entire disclosures are herewith incorporated by reference.

The invention relates to a method of winding a metal strip, particularly a steel strip, into a coil, with the strip guided between a feeding device comprised of at least one upper feed roller and at least one lower feed roller, and a winding mandrel, and with the strip being wound into a coil on the winding mandrel. The invention further relates to an apparatus for winding a metal strip.

A hot strip coiler is provided at the end of the hot strip mill. This coiler has the function of winding the hot strip into a coil after rolling, with the strip being wound under tension in order obtain a sufficiently tightly wound strip and to prevent the coil from unwinding once winding has been completed. The tensile stress is also necessary for bending the strip around the winding mandrel, i.e. plastically deforming it. Large degrees of tensile stress are particularly necessary for generating the bending moment required for plastic deformation in the case of thick strips.

Figure 1:
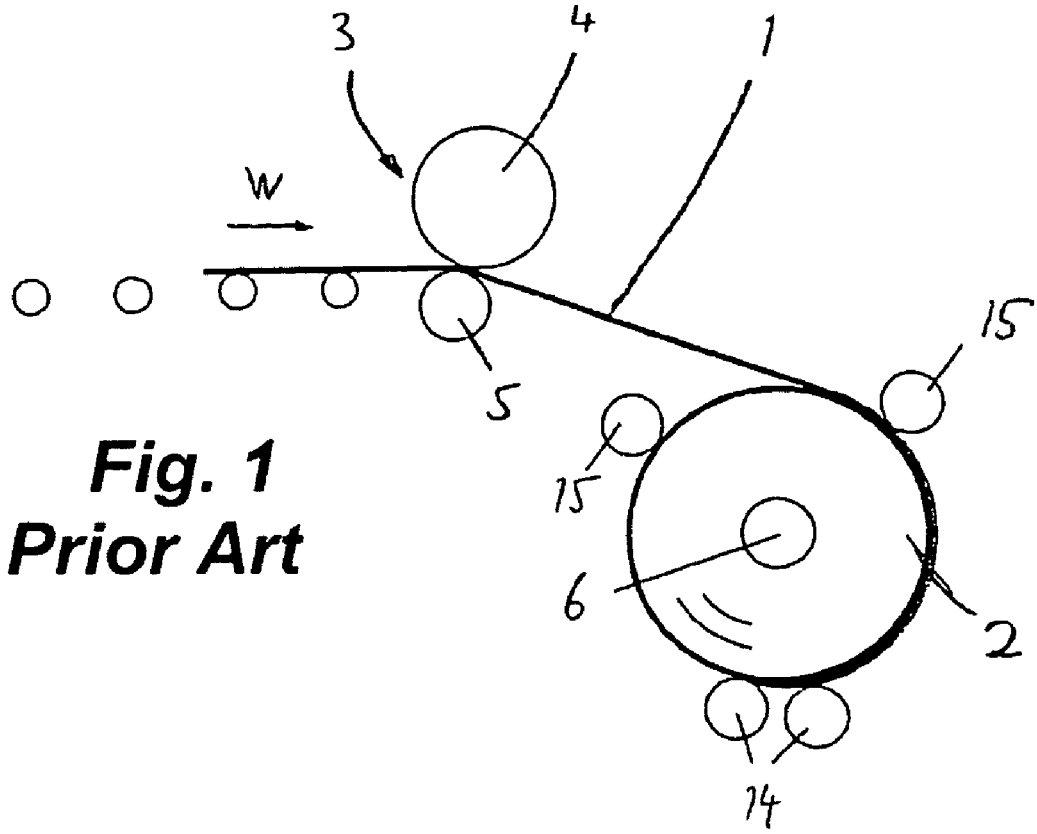
Fig. 1 Prior Art
Figure 2:
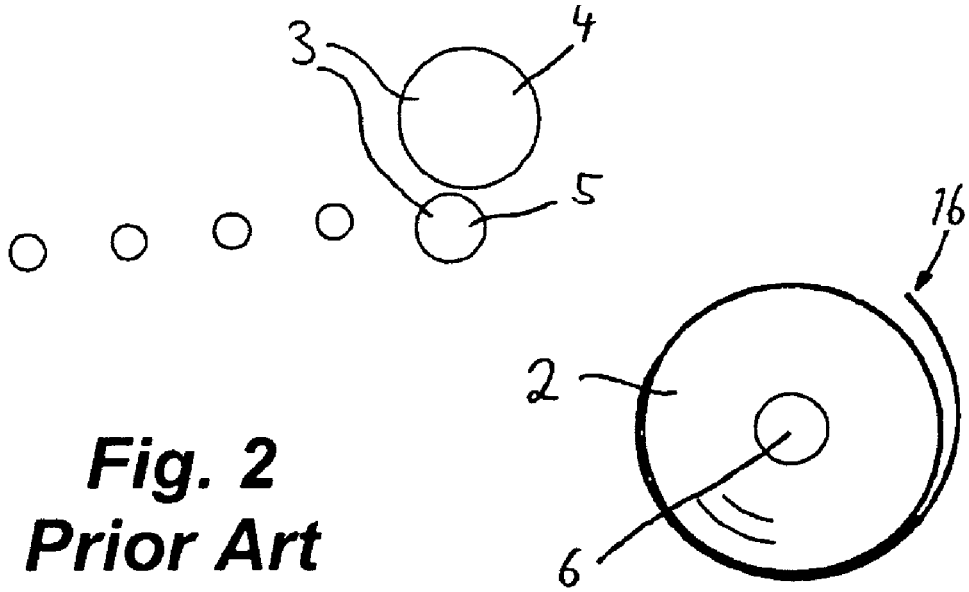
Fig. 2 Prior Art
Figure 3:
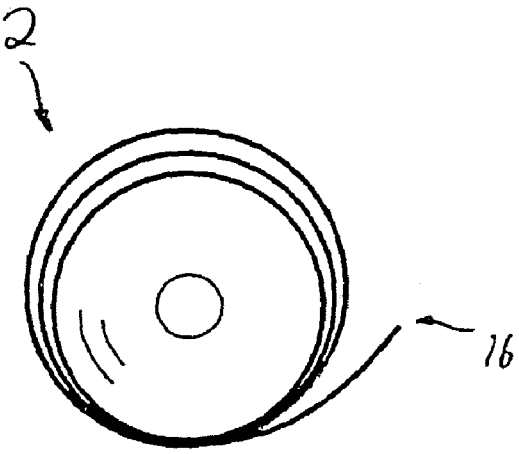
Fig. 3 Prior Art

FIGS. 1 to 3 show solutions and problems of the prior art.

As can be seen in FIG. 1, a strip 1 is guided through a feeding device 3 during winding that is comprised of an upper drive roller 4 and a lower feed roller 5, the strip being guided from the feeding device 3 to a winding mandrel 6. The strip 1 is wound onto the winding mandrel 6 until a coil 2 has formed. The coil 2 is removed from the winding mandrel 6 after the completed winding of the strip 1. During winding, a defined tensile stress is maintained in the strip 1 between the feeding device 3 and the winding mandrel 6.

Once the strip end leaves the feeding device 3, the downstream end portion of the strip can no longer be maintained under tension. In order to apply the trailing strip end to the coil 2 in this phase, a coil carriage 14 (shown by two rolls of the carriage) and one or more pressure rolls 15 are then pressed against the coil 2. In spite of the plastic flexing of the strip 1, an elastic residual tension remains in the strip 1 that leads to the strip end 16 sticking out from the coil 2 as shown in FIG. 2.

Particularly in the case of strips 1 with strip thicknesses greater than 12 mm, the danger is present of the coil 2 uncoiling during continued transport or if the coil 2 tips over, as shown in FIG. 3.

If a coil uncoils in this fashion, it can no longer be firmly rewound in a simple manner, and as a rule such a coil then becomes waste.

In order to prevent this, coils 2 are wrapped with steel straps. The thicker and firmer the material of the strip 1, the more steel straps are required to safely hold the coil together. In the case of strip thicknesses greater than 12 mm, a large number of steel straps may be required.

In EP 0 906 797 [U.S. Pat. No. 6,128,937], the steel strip to be wrapped is guided through a number of cooperating rolls that may also be arranged between the feeding device and the winding mandrel. However, these rolls are stationary such that they deform the strip independently of the position of the strip end.

JP 0708 0531 attempts to influence the bending of the strip in that the one feed roller is driven at a higher speed than the other, which causes the strip to bend. This principle is also applied in JP 0707 5830.

JP 5805 8931 uses a number of bending rolls to improve the position of the strip end on the coil, with the bending rolls directly engaging the strip.

Insofar as they attempt to influence the bending of the strip in a targeted fashion, all of the known options represent a relatively high outlay for equipment and control. However, the result continues to not always be satisfactory.

The object of the invention is therefore to refine a method and an apparatus of the type mentioned above such that the disadvantages mentioned above may be prevented or at least reduced. A further object of the invention is to ensure in a simple fashion that the strip that has been wound into a coil on the winding mandrel no longer detaches, but rather that the strip end lies against the coil in a fixed manner. This object should be attained in a simple manner from an equipment standpoint and thus in a cost-effective manner. The invention should particularly allow the wrapping of the wound coil with a steel strap to be omitted.

This object is attained according to the invention in terms of the method in that, upon reaching a defined trailing length of the strip, particularly upstream of the feeding device, a bending moment is applied to the strip, the bending moment acting transversely to the longitudinal direction of the strip and causing plastic deformation. The bending moment may preferably be applied in the region between the feeding device and the winding mandrel. In principle, however, it is also possible for the bending moment to be applied to the strip upstream of the feeding device, such that the strip is subjected to plastic deformation and/or curvature. The bending moment bends the strip in the direction in which it is curved on the winding mandrel. Thus, a curve is virtually preset upstream of the coil such that, after completing the winding of the strip onto the winding mandrel, the outermost winding or windings rest firmly against the outer surface of the coil and do not tend to unwind.

According to a preferred embodiment of the invention, in order to produce the bending moment, at least one upper feed roller of the feeding device may be displaced in the rolling direction and lowered perpendicular to the surface of the strip. In this case, provision may be made for the strip to be held down at a point upstream in the rolling direction perpendicular to the surface of the strip.

In order to produce the bending moment, it is also possible for the lower feed roller of the feeder to be displaced in the rolling direction and lifted perpendicular to the surface of the strip. In this case, the strip would preferably be held up at a point upstream in the rolling direction perpendicular to the surface of the strip.

An alternative approach is based on a number of rolls being moved up to the strip on both sides between the feeding device and the winding mandrel for the purpose of producing the bending moment.

All of these measures serve to introduce a bending moment into the strip that causes a plastic precurve such that, after the completed winding of the strip onto the coil, uncoiling of the outermost strip winding is prevented.

In order to keep the strip from plastically unbending after the plastic precurve resulting from the bending moment applied, a preferred embodiment provides for the longitudinal tension in the strip be reduced upon or after the application of the binding moment.

The apparatus for winding a metal strip, particularly a steel strip, into a coil has a feeding device with at least one upper feed roller and at least one lower feed roller as well as a winding mandrel, with the strip being kept under longitudinal tension between the feeding device and the winding mandrel and with the strip being wound into the coil on the winding mandrel.

Means are provided according to the invention for applying a bending moment acting transversely to the longitudinal direction of the strip and causing a plastic deformation, the means being activated by the control means as soon as a defined trailing length of the strip has been attained, i.e. the means become active when the downstream end of the strip reaches a defined position.

The means may include at least one actuator by means of which the upper feed roller and/or the lower feed roller may be displaced in the rolling direction and raised or lowered perpendicular to the surface of the strip.

The means may also include a number of rollers that may be moved up to the strip on both sides between the feeding device and the winding mandrel.

Thus, the core of the invention is a method and an apparatus for the targeted bending of the metal strip at the strip end, the effort being made for the trailing tension in the strip to be adjusted such that the outermost turns of the strip (i.e. the strip end) rests firmly against the coil. In this manner, the number of steel straps for binding the coil may be reduced and the transport and tipping of the coils may be made safer.

Figure 4:
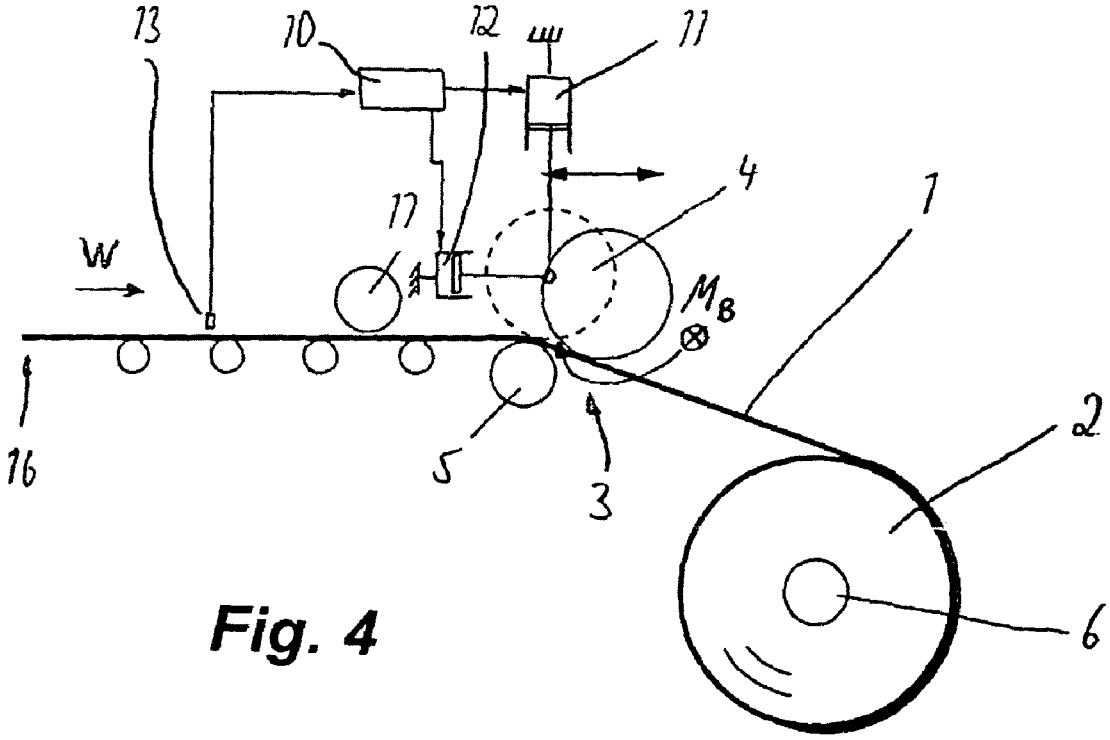
Figure 5:
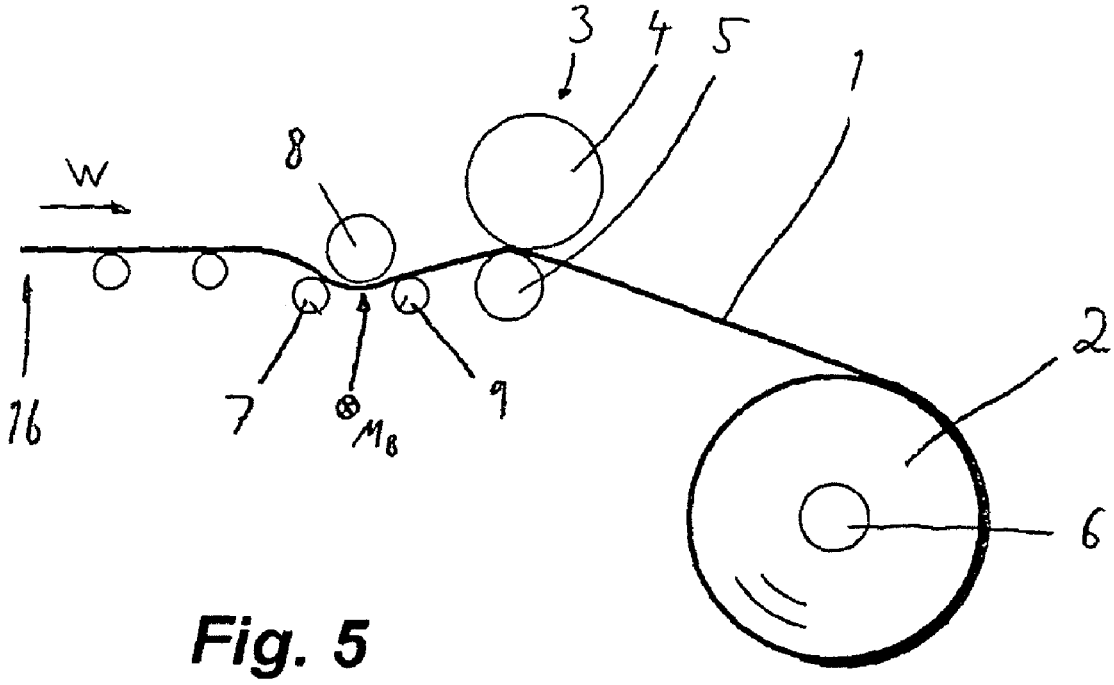
Figure 6:
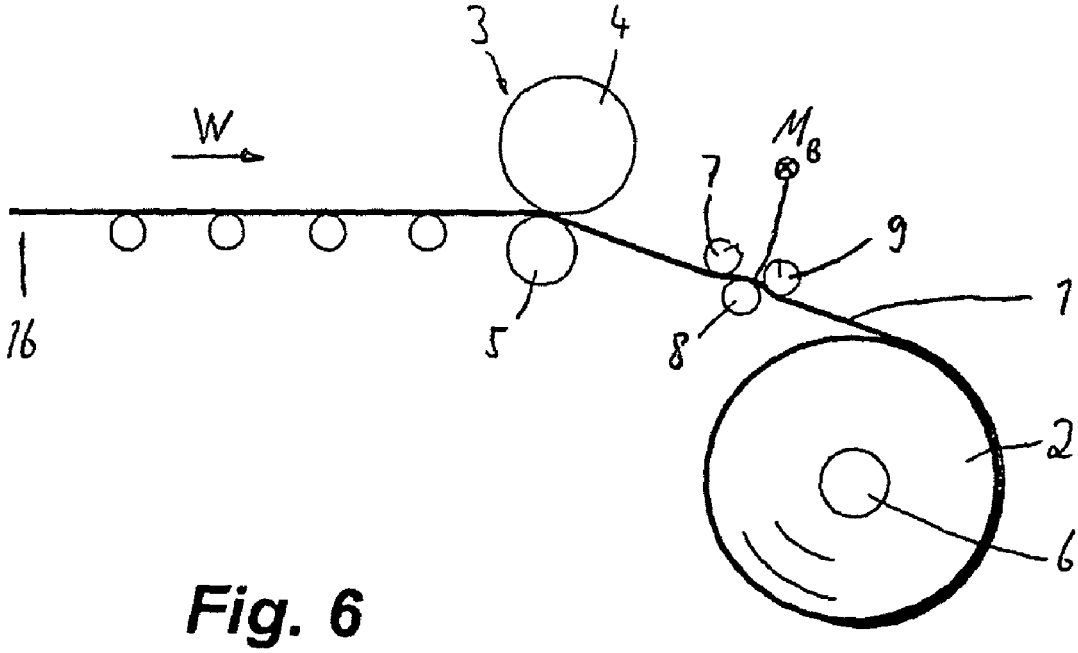

Embodiments of the invention are shown in the drawings, in which:

FIG. 1 shows an apparatus for winding a steel strip according to the prior art having a feeding device and a winding mandrel on which the steel strip is wound into a coil, FIG. 2 shows the steel strip that has been completely wound onto the winding mandrel according to the prior art, FIG. 3 shows the coil wound according to the prior art from which the strip end has detached, FIG. 4 shows an apparatus for winding a steel strip in an embodiment according to the invention, FIG. 5 shows an alternative apparatus for winding the steel strip according to the invention, and FIG. 6 shows a further alternative apparatus for winding the steel strip according to the invention.

As in the prior art, the apparatus for winding a steel strip 1 shown in FIG. 4 has a feeding device 3 with an upper feed roller 4 and a lower feed roller 5 and a winding mandrel 6 onto which the strip 1 is wound into the coil 2.

During a normal winding operation, the upper feed roller 4 is located in the position drawn with dashed lines. The two feed rollers 4, 5 are pressed against one another such that the strip 1 may be preferably held under a defined tension between the feeding device 3 and the winding mandrel 6. This tension ensures that a defect-free winding of the strip 1 onto the winding mandrel 6 is possible. If needed, it is possible for the strip to be wound with a very low tension or even none at all.

It becomes problematic when the end of the strip is reached such that the strip 1 is no longer gripped between the upper feed roller 4 and the lower feed roller 5. In such a case, only the coil carriage 14 and the pressure rolls 15 shown in FIG. 1 are able to ensure that the strip end and therefore the final windings rest against the coil 2.

In contrast, in the illustrated embodiment according to FIG. 4, the invention does the following: Arrival of the trailing strip end 16 is detected by means of a sensor 13 that sends its signal to the control means 10. The control means 10 transmits actuation signals to two actuators 11 and 12 that move the upper feed roller 4 downstream in the rolling direction W and, at the same time, downward, i.e. into the position shown with solid lines. A hold-down roller 17 upstream of the feeding device 3 in the rolling direction ensures that the strip 1 is unable to lift upward as a result of the displacement of the upper feed roller 4. Rather, a bending moment $M_B$ is applied to the strip 1 by the three rolls 4, 5, and 17, the bending moment being positioned, as shown in FIG. 4, transversely to the longitudinal direction of the strip 1 (the moment vector is perpendicular to the plane of the drawing) and the moment being selected such that plastic bending deformation of the strip 1 occurs. Here, the strip 1 is plastically deformed and bent in the direction corresponding to the turns on the winding mandrel.

Once the strip end 16 leaves the region of the feeding device 3, the final strip section is prebent such that it rests against the coil 2, thus preventing an undesired unwinding of the coil 2. The positioning of the upper drive roller 4 depends on the desired effect, which is selected such that, in its final state, the outermost winding of the strip 1 rests well against the coil 2.

Therefore, the apparatus shown serves to bend the strip end or the trailing region of the strip end, with the hold-down roller 17, the lower feed roller 5, and the upper feed roller 4 being used. The upper feed roller 4 is displaced and its height adjusted for bending purposes. The bending radius may be adjusted according to the goal discussed above or arbitrarily.

The application of the bending moment $M_B$ begins at a certain point on the strip 1 that may be predetermined by strip tracking. Then the upper feed roller 4 is placed in a position that may be predetermined so that a desired bending radius is obtained but the contact force for the feed roller does not become too great. At the strip end 16, the strip pull between the feeding device 3 and the winding mandrel 6 is reduced in order to prevent the strip from bending back. The work for feeding the strip 1 and for the plastic ending of the region of the strip end is supplied by the feeding device 3.

In the embodiment of the invention according to FIG. 5, as soon as the strip end 16 is detected by a sensor (not shown here), the three rolls 7, 8, and 9, which previously did not generate any bending moment in the strip, are moved into the position shown. This also causes a preliminary plastic deformation of the strip as a result of the bending moment $M_B$ generated, such that the strip 1, after it has left the region of the feeding device 3, lies well against the coil 2 and the outermost strip turn does not have a tendency to unwind.

In the solution according to FIG. 5, a part of the roller path, namely between the rolls 7 and 9, is lowered and the hold-down roller 8 is moved against the strip 1. The bending radius of the strip 1 is adjusted by the position of the hold-down roller 8.

While the three rolls 7, 8, and 9 in FIG. 5 are upstream of the feeding device 3 in the rolling direction W they may actually also be downstream of the feeding device 3 as shown in FIG. 6. Here, the bending moment $M_B$ that causes a plastic deformation of the strip 1 in the direction of the curve present in the wound state on the coil 2 is applied to the strip 1 directly upstream of the winding mandrel 6.

In FIG. 6, a separate three-roller bending unit is therefore provided between the feeding device 3 and the winding mandrel 6. This unit may be pivoted against the strip at the strip end in that the two upper rolls 7 and 9 are pressed against the strip 1 from above and the lower roller 8 from below. Here, the bending radius of the region of the strip end is adjusted by the position of the upper and lower rolls.

LIST OF REFERENCE CHARACTERS

1 Strip (steel strip)
2 Coil

3 Feeding device
4 Upper feed roller
5 Lower feed roller
6 Winding mandrel
7 Roll
8 Roll
9 Roll
10 Control means
11 Actuator
12 Actuator
13 Sensor
14 Coil carriage
15 Pressure rolls
16 Strip end
17 Hold-down roll
$M_B$ Bending moment
W Rolling direction

The invention claimed is:

1. A method of operating a strip-winding apparatus having:

upper and lower feed rollers gripping the strip and advancing it in a travel direction, and a mandrel downstream in the direction from the feed rollers and rotatable to wind up the strip;

the method comprising the steps of:

engaging a holddown roller against the strip upstream of the feed rollers and thereby holding down the strip;

when a downstream end portion of the strip has a predetermined length, shifting the upper feed roller downstream and then transversely downward against the strip while holding the lower feed roller against movement in the travel direction and thereby applying to the strip a bending moment sufficient to plastically deform the downstream end portion.

2. The strip-winding defined in claim 1 wherein the downstream end portion is deformed so as to be concavely arcuate toward the mandrel when wound thereon.

3. The strip-winding defined in claim 1, further comprising the step of reducing longitudinal tension in the downstream end portion of strip during plastic deformation thereof.

4. The strip-winding defined in claim 1, further comprising the step of supporting the strip immediately upstream and downstream of the holddown roller by engaging support rollers upward against the strip immediately upstream and downstream of the holddown roller.

5. The strip-winding defined in claim 1, further comprising the step of providing a sensor upstream of the feed rollers to monitor when the downstream end of the downstream end portion arrives at the sensor; and initiating downstream movement of the upper feed roller on detection of the downstream end.

6. A strip-winding apparatus comprising:

upper and lower feed rollers gripping the strip and advancing it in a travel direction, and a mandrel downstream in the direction from the feed rollers and rotatable to wind up the strip;

a holddown roller engaged downward against the strip upstream of the feed rollers and thereby holding down the strip;

control means for, when a downstream end portion of the strip has a predetermined length, shifting the upper feed roller downstream and then transversely downward against the strip while holding the lower feed roller against movement in the travel direction and thereby applying to the strip a bending moment sufficient to plastically deform the downstream end portion.

* * * * *